US010312593B2

(12) United States Patent
Yarga et al.

(10) Patent No.: US 10,312,593 B2
(45) Date of Patent: Jun. 4, 2019

(54) ANTENNAS FOR NEAR-FIELD AND NON-NEAR-FIELD COMMUNICATIONS

(71) Applicant: Apple Inc., Cupertino, CA (US)

(72) Inventors: Salih Yarga, Sunnyvale, CA (US); Miroslav Samardzija, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 196 days.

(21) Appl. No.: 14/254,604

(22) Filed: Apr. 16, 2014

(65) Prior Publication Data

US 2015/0303568 A1 Oct. 22, 2015

(51) Int. Cl.
*H01Q 5/00* (2015.01)
*H01Q 7/00* (2006.01)
(Continued)

(52) U.S. Cl.
CPC ..... *H01Q 7/005* (2013.01); *H01Q 1/245* (2013.01); *H01Q 5/321* (2015.01);
(Continued)

(58) Field of Classification Search
CPC .... H01Q 1/245; H01Q 5/0034; H01Q 9/0421; H01Q 9/42; H01Q 7/005; H01Q 1/2266; H01Q 1/243; H01Q 21/28
(Continued)

(56) References Cited

U.S. PATENT DOCUMENTS 5,936,583 A 8/1999 Sekine et al.
6,308,051 B1 * 10/2001 Atokawa ..... H01P 1/213 333/207
(Continued)

FOREIGN PATENT DOCUMENTS

EP 2498336 9/2012
EP 2528165 11/2012
(Continued)

OTHER PUBLICATIONS

Abbaspour-Tamijani et al. "Antenna-Filter-Antenna Arrays as a Class of Bandpass Frequency-Selective Surfaces", IEEE Transactions on Microwave Theory and Techniques, vol. 52, No. 8, Aug. 2004.*
(Continued)

*Primary Examiner* — Dieu Hien T Duong
*Assistant Examiner* — Bamidele A Jegede
(74) *Attorney, Agent, or Firm* — Treyz Law Group, P.C.; G. Victor Treyz; Tianyi He

(57) ABSTRACT

An electronic device may be provided with antenna structures. The antenna structures may be coupled to non-near-field communications circuitry such as cellular telephone transceiver circuitry or wireless local area network circuitry. When operated at non-near-field communication frequencies, the antenna structures may be configured to serve as one or more inverted-F antennas or other antennas for supporting far field wireless communications. Proximity sensor circuitry and near-field communications circuitry may also be coupled to the antenna structures. When operated at proximity sensor frequencies, the antenna structures may be used in forming capacitive proximity sensor electrode structures. When operated at near-field communications frequencies, the antenna structures may be used in forming an inductive near-field communications loop antenna.

20 Claims, 9 Drawing Sheets

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 5/321*** | (2015.01) |
| *H01Q 1/22* | (2006.01) |
| *H01Q 21/28* | (2006.01) |

(52) U.S. Cl.
CPC ..... *H01Q 9/0421* (2013.01); *H01Q 9/42* (2013.01); *H01Q 1/2266* (2013.01); *H01Q 1/243* (2013.01); *H01Q 21/28* (2013.01)

(58) Field of Classification Search
USPC ..... 455/41.1; 343/720, 722
See application file for complete search history.

(56) References Cited

U.S. PATENT DOCUMENTS

| | | | | |
|---|---|---|---|---|
| 6,556,630 | B1 * | 4/2003 | Brinsfield | H04B 1/406 340/870.11 |
| 6,600,450 | B1 | 7/2003 | Efanov et al. | |
| 6,950,410 | B1 * | 9/2005 | Brandt | H04B 1/406 370/276 |
| 7,408,515 | B2 | 8/2008 | Liesten | |
| 7,423,606 | B2 | 9/2008 | Knadle, Jr. et al. | |
| 7,450,072 | B2 * | 11/2008 | Kim | H01Q 1/243 343/700 MS |
| 7,505,001 | B2 | 3/2009 | Deavours et al. | |
| 7,772,941 | B2 | 8/2010 | Yeung et al. | |
| 7,834,813 | B2 * | 11/2010 | Caimi | H01Q 9/045 343/745 |
| 7,843,347 | B2 | 11/2010 | Nikitin et al. | |
| 7,873,385 | B2 | 1/2011 | Boireau et al. | |
| 7,973,722 | B1 | 7/2011 | Hill et al. | |
| 8,041,227 | B2 | 10/2011 | Holcombe et al. | |
| 8,238,825 | B2 | 8/2012 | Rofougaran et al. | |
| 8,369,959 | B2 | 2/2013 | Meskens | |
| 8,417,296 | B2 | 4/2013 | Caballero et al. | |
| 8,418,296 | B1 | 4/2013 | Caballero et al. | |
| 8,432,322 | B2 | 4/2013 | Amm et al. | |
| 8,466,839 | B2 | 6/2013 | Schlub et al. | |
| 8,577,289 | B2 | 11/2013 | Schlub et al. | |
| 8,606,215 | B2 | 12/2013 | Sharma | |
| 8,818,450 | B2 | 8/2014 | Caballero et al. | |
| 8,947,305 | B2 | 2/2015 | Amm et al. | |
| 2002/0140612 | A1 * | 10/2002 | Kadambi | H01Q 9/0421 343/702 |
| 2006/0055618 | A1 | 3/2006 | Poilasne et al. | |
| 2007/0069960 | A1 * | 3/2007 | Moon | H01Q 1/521 343/700 MS |
| 2007/0279287 | A1 | 12/2007 | Castaneda et al. | |
| 2008/0074341 | A1 * | 3/2008 | Chung | H01Q 1/243 343/841 |
| 2008/0081631 | A1 * | 4/2008 | Rofougaran | H01Q 1/38 455/452.1 |
| 2009/0058735 | A1 | 3/2009 | Hill et al. | |
| 2009/0073070 | A1 | 3/2009 | Rofougaran | |
| 2009/0143028 | A1 | 6/2009 | Kim | |
| 2009/0180451 | A1 | 7/2009 | Alpert et al. | |
| 2009/0322639 | A1 * | 12/2009 | Lai | H01Q 1/243 343/770 |
| 2010/0007568 | A1 | 1/2010 | Fear et al. | |
| 2010/0222010 | A1 | 9/2010 | Ozaki et al. | |
| 2010/0279734 | A1 * | 11/2010 | Karkinen | H01Q 3/24 455/554.2 |
| 2011/0148733 | A1 | 6/2011 | Fahs et al. | |
| 2011/0148736 | A1 * | 6/2011 | Choi | H01Q 1/38 343/893 |
| 2011/0241949 | A1 | 10/2011 | Nickel et al. | |
| 2011/0243120 | A1 | 10/2011 | Ginsburg et al. | |
| 2012/0135681 | A1 | 5/2012 | Adams et al. | |
| 2012/0214412 | A1 * | 8/2012 | Schlub | G01B 7/023 455/41.1 |
| 2012/0258660 | A1 | 10/2012 | Rajendran et al. | |
| 2012/0299785 | A1 * | 11/2012 | Bevelacqua | H01Q 9/42 343/702 |
| 2013/0002511 | A1 * | 1/2013 | Higaki | H01Q 9/42 343/861 |
| 2013/0017867 | A1 * | 1/2013 | Lee | H01Q 7/06 455/566 |
| 2013/0057446 | A1 * | 3/2013 | Hirobe | H01Q 1/243 343/851 |
| 2013/0109433 | A1 | 5/2013 | Wang et al. | |
| 2013/0189923 | A1 | 7/2013 | Lewin | |
| 2013/0019413 | A1 | 8/2013 | Nickel et al. | |
| 2013/0194139 | A1 | 8/2013 | Nickel et al. | |
| 2013/0203364 | A1 * | 8/2013 | Darnell | H01Q 1/243 455/77 |
| 2013/0217342 | A1 | 8/2013 | Abdul-Gaffoor et al. | |
| 2013/0231046 | A1 | 9/2013 | Pope et al. | |
| 2013/0241796 | A1 * | 9/2013 | Nagumo | H01Q 1/243 343/861 |
| 2013/0300618 | A1 * | 11/2013 | Yarga | H01Q 1/243 343/720 |
| 2014/0045442 | A1 | 2/2014 | Caruana et al. | |
| 2014/0062812 | A1 | 3/2014 | Smith et al. | |
| 2014/0128032 | A1 | 5/2014 | Muthukumar | |
| 2014/0139380 | A1 * | 5/2014 | Ouyang | H01Q 7/00 343/702 |
| 2014/0306857 | A1 | 10/2014 | Bevelacqua et al. | |
| 2014/0320365 | A1 * | 10/2014 | Hong | H01Q 1/38 343/787 |
| 2014/0328488 | A1 | 11/2014 | Caballero et al. | |

FOREIGN PATENT DOCUMENTS

| | | | |
|---|---|---|---|
| EP | 2618497 | | 7/2013 |
| EP | 2800200 | A1 | 11/2014 |
| KR | 10-2012-0084770 | | 7/2012 |
| KR | 10-2012-0102516 | | 9/2012 |
| KR | 2012-0103297 | A | 9/2012 |
| TW | 201240379 | | 10/2012 |
| WO | 2012127097 | | 9/2012 |
| WO | 2013147823 | | 10/2013 |
| WO | 2014077951 | A1 | 5/2014 |

OTHER PUBLICATIONS

Irci et al., U.S. Appl. No. 14/262,486, filed Apr. 25, 2014.
Ouyang et al., U.S. Appl. No. 14/195,247, filed Mar. 3, 2014.
Ouyang et al., U.S. Appl. No. 14/195,130, filed Mar. 3, 2014.
Yarga et al., U.S. Appl. No. 14/254,604, filed Apr. 16, 2014.
Schlub et al., U.S. Appl. No. 13/865,578, filed Apr. 18, 2013.
Balanis, "Antenna Theory: A Review", Proceedings of the IEEE, vol. 80, No. 1, Jan. 1992.

* cited by examiner

ANTENNAS FOR NEAR-FIELD AND NON-NEAR-FIELD COMMUNICATIONS

BACKGROUND

This relates to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry such as near-field communications circuitry. Near-field communications schemes involve electromagnetically coupled communications over short distances, typically 20 cm or less.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover a near-field communications band while simultaneously covering additional non-near-field (far field) bands such cellular telephone bands, wireless local area network bands, and satellite navigation system bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may be provided with wireless circuitry. The wireless circuitry may include antenna structures.

The antenna structures may be coupled to non-near-field communications circuitry such as cellular telephone transceiver circuitry and wireless local area network circuitry. When operated at non-near-field communication frequencies, the antenna structures may be configured to serve as one or more far-field antennas. As an example, the antenna structures may be configured to form one or more inverted-F antennas when operated at non-near-field communications frequencies such as frequencies above 700 MHz.

Proximity sensor circuitry and near-field communications circuitry may also be coupled to the antenna structures. When operated at proximity sensor frequencies such as frequencies of about 200 kHz, the antenna structures may be used in forming capacitive proximity sensor electrode structures. Low pass filter circuitry may be used to couple the proximity sensor circuitry to the antenna structures.

The antenna structures may include frequency-dependent antenna circuitry such as band pass filter circuitry, capacitors (high-pass filters), inductors (low pass filters), and other frequency-dependent circuits. The band pass filter circuitry may have a pass band that passes signals at near-field communications frequencies such as 13.56 MHz. At non-near-field communications frequencies, the antenna circuitry is configured to form the inverted-F antennas or other far-field antennas for supporting wireless local area network communications, cellular telephone communications, and other non-near-field wireless signals.

When operated at near-field communications frequencies, the band pass filters, low pass filters, capacitors, and other antenna circuitry may be configured to form open and closed circuits that cause the inverted-F antenna structures to form a near-field communications loop antenna while isolating the proximity sensor circuitry and non-near-field communications circuitry.

DETAILED DESCRIPTION

Electronic devices may be provided with antenna structures. The antenna structures may include antennas for cellular telephone communications and/or other far-field (non-near-field) communications. Circuitry in the antenna structures may allow the antenna structures to form a near-field communications loop antenna to handle near-field communications. The antenna structures may also include structures that can be used to gather proximity sensor data. Illustrative electronic devices that may include antenna structures such as these are shown in FIGS. 1, 2, 3, and 4.

Figure 1:
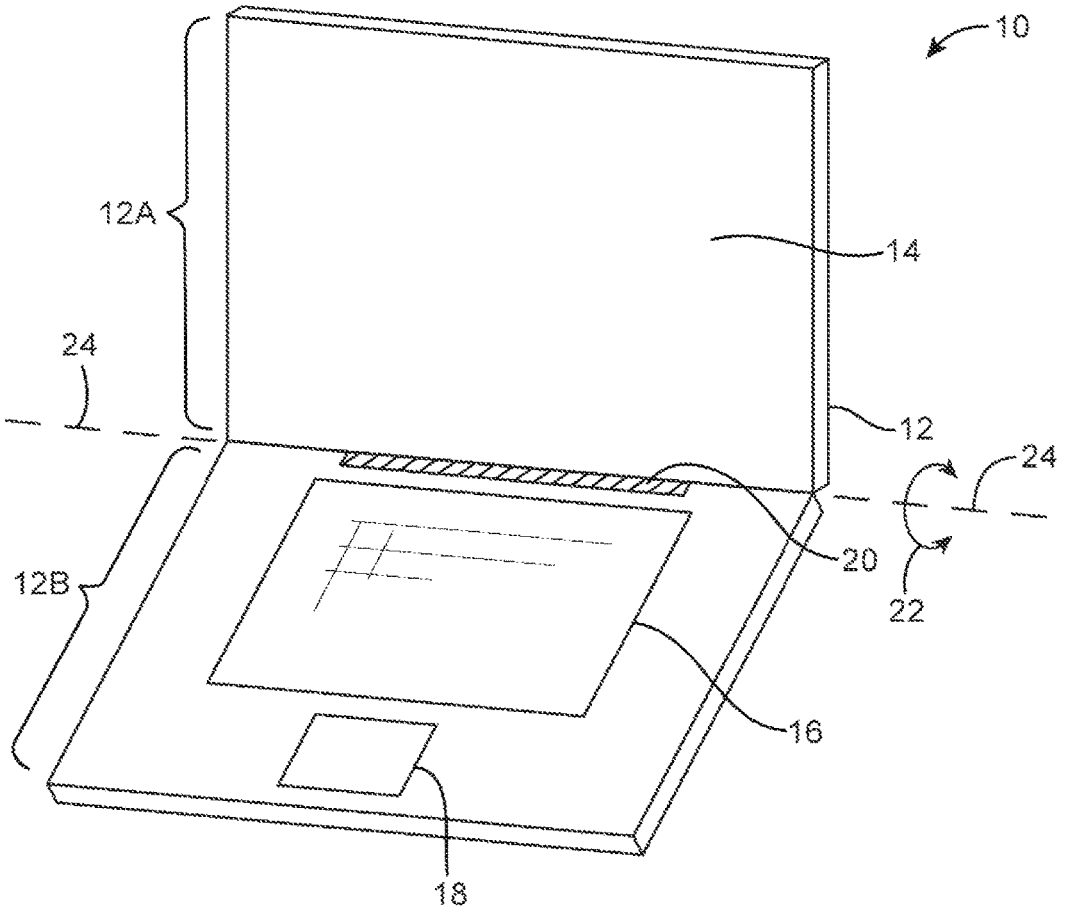
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes be referred to as a display housing or lid, is placed in a closed position by rotating upper housing 12A towards lower housing 12B about rotational axis 24.

Figure 2:
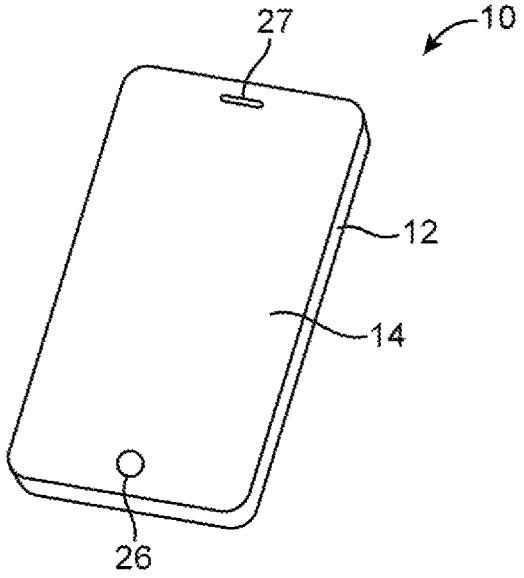
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, device 10 has opposing front and rear surfaces. The rear surface of device 10 may be formed from a planar portion of housing 12. Display 14 forms the front surface of device 10. Display 14 may have an outermost layer that includes openings for components such as button 26 and speaker port 27.

Figure 3:
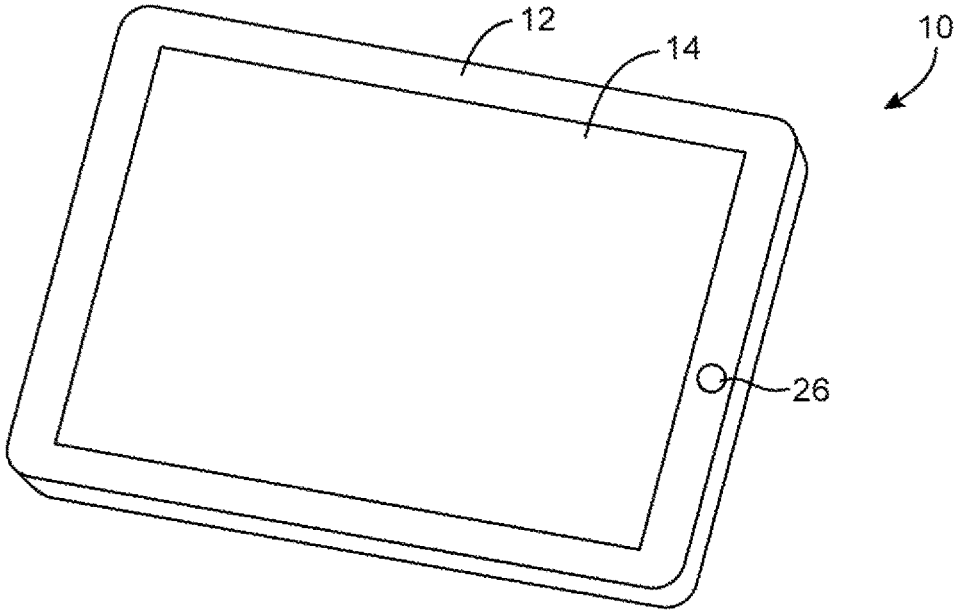
FIG. 3 is a perspective view of an illustrative electronic device such as a tablet computer in accordance with an embodiment.

In the example of FIG. 3, electronic device 10 is a tablet computer. In electronic device 10 of FIG. 3, device 10 has opposing planar front and rear surfaces. The rear surface of device 10 is formed from a planar rear wall portion of housing 12. Curved or planar sidewalls may run around the periphery of the planar rear wall and may extend vertically upwards. Display 14 is mounted on the front surface of device 10 in housing 12. As shown in FIG. 3, display 14 has an outermost layer with an opening to accommodate button 26.

Figure 4:
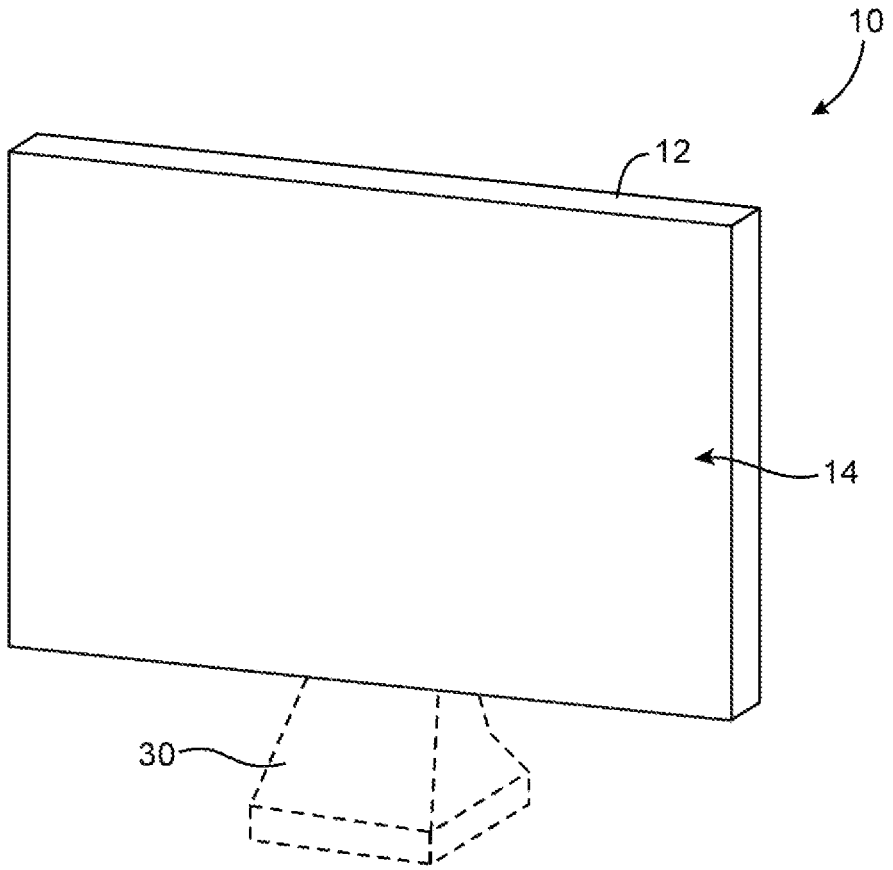
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of device 10 in housing 12. With this type of arrangement, housing 12 for device 10 may be mounted on a wall or may have an optional structure such as support stand 30 to support device 10 on a flat surface such as a tabletop or desk.

An electronic device such as electronic device 10 of FIGS. 1, 2, 3, and 4, may, in general, be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The examples of FIGS. 1, 2, 3, and 4 are merely illustrative.

Device 10 may include a display such as display 14. Display 14 may be mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button, an opening may be formed in the display cover layer to accommodate a speaker port, etc. Display 14 may have an active area and an inactive area. For example, display 14 may have a rectangular central region that contains an array of display pixels that display images for a user. The active region may be surrounded by a peripheral border region that is inactive. The inactive border of the display does not contain display pixels and does not display images for a user. The display cover layer may cover the inactive border. To block interior components of device 10 from view, the inner surface of the display cover layer may be coated with an opaque masking material such as a layer of black ink in the inactive area. Antenna structures may be formed in portions of device 10 that lie beneath the inactive regions of display 14 to minimize interference between the antenna structures and conductive display structures.

Housing 12 may be formed from conductive materials and/or insulating materials. In configurations in which housing 12 is formed from plastic or other dielectric materials, antenna signals can pass through housing 12. Antennas in this type of configuration can be mounted behind a portion of housing 12. In configurations in which housing 12 is formed from a conductive material (e.g., metal), it may be desirable to provide one or more radio-transparent antenna windows in openings in the housing. As an example, a metal housing may have openings that are filled with plastic antenna windows. Antennas may be mounted behind the antenna windows and may transmit and/or receive antenna signals through the antenna windows.

Figure 5:
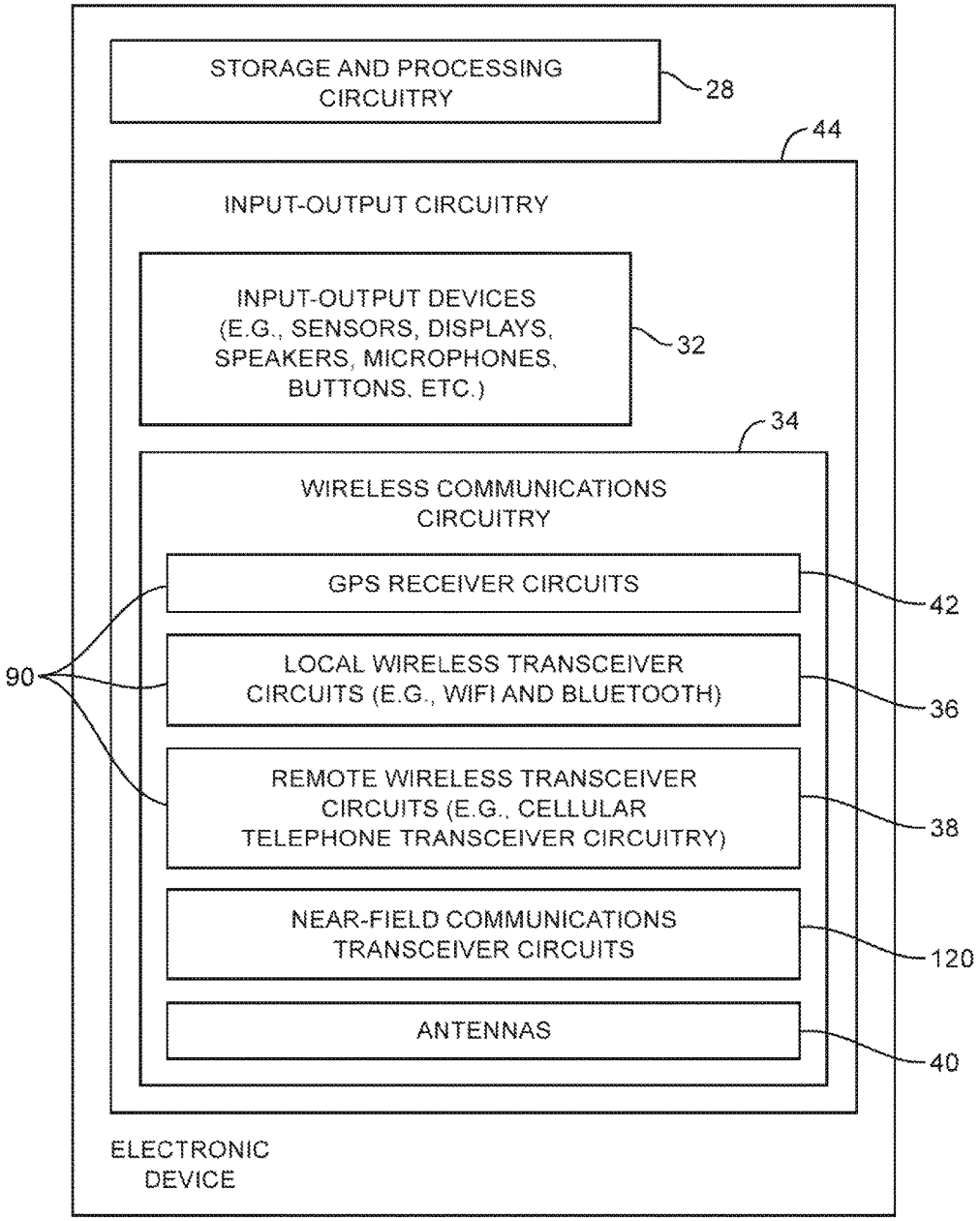
FIG. 5 is a schematic diagram of illustrative circuitry in an electronic device in accordance with an embodiment.

A schematic diagram showing illustrative components that may be used in device 10 is shown in FIG. 5. As shown in FIG. 5, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 may include satellite navigation system circuitry such as global positioning system (GPS) receiver circuitry 42 for receiving GPS signals at 1575 MHz or for handling other satellite positioning data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless circuitry 34 may include near-field communications circuitry 120. Near-field communications circuitry 120 may produce and receive near-field communications signals to support communications between device 10 and a near-field communications reader or other external near-field communications equipment. Near-field communications may be supported using loop antennas (e.g., to support inductive near-field communications in which a loop antenna in device 10 is electromagnetically near-field coupled to a corresponding loop antenna in a near-field communications reader). Near-field communications links typically are generally formed over distances of 20 cm or less (i.e., device 10 must be placed in the vicinity of the near-field communications reader for effective communications).

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna. In addition to supporting cellular telephone communications, wireless local area network communications, and other far-field wireless communications, the structures of antennas 40 may be used in supporting near-field communications. The structures of antennas 40 may also be used in gathering proximity sensor signals (e.g., capacitive proximity sensor signals).

Radio-frequency transceiver circuitry 90 does not handle near-field communications signals and is therefore sometimes referred to as far field communications circuitry or non-near-field communications circuitry. Near-field communications transceiver circuitry 120 may be used in handling near-field communications. With one suitable arrangement, near-field communications can be supported using signals at a frequency of 13.56 MHz. Other near-field communications bands may be supported using the structures of antennas 40 if desired. Transceiver circuitry 90 may handle non-near-field communications frequencies (e.g., frequencies above 700 MHz or other suitable frequency).

Figure 6:
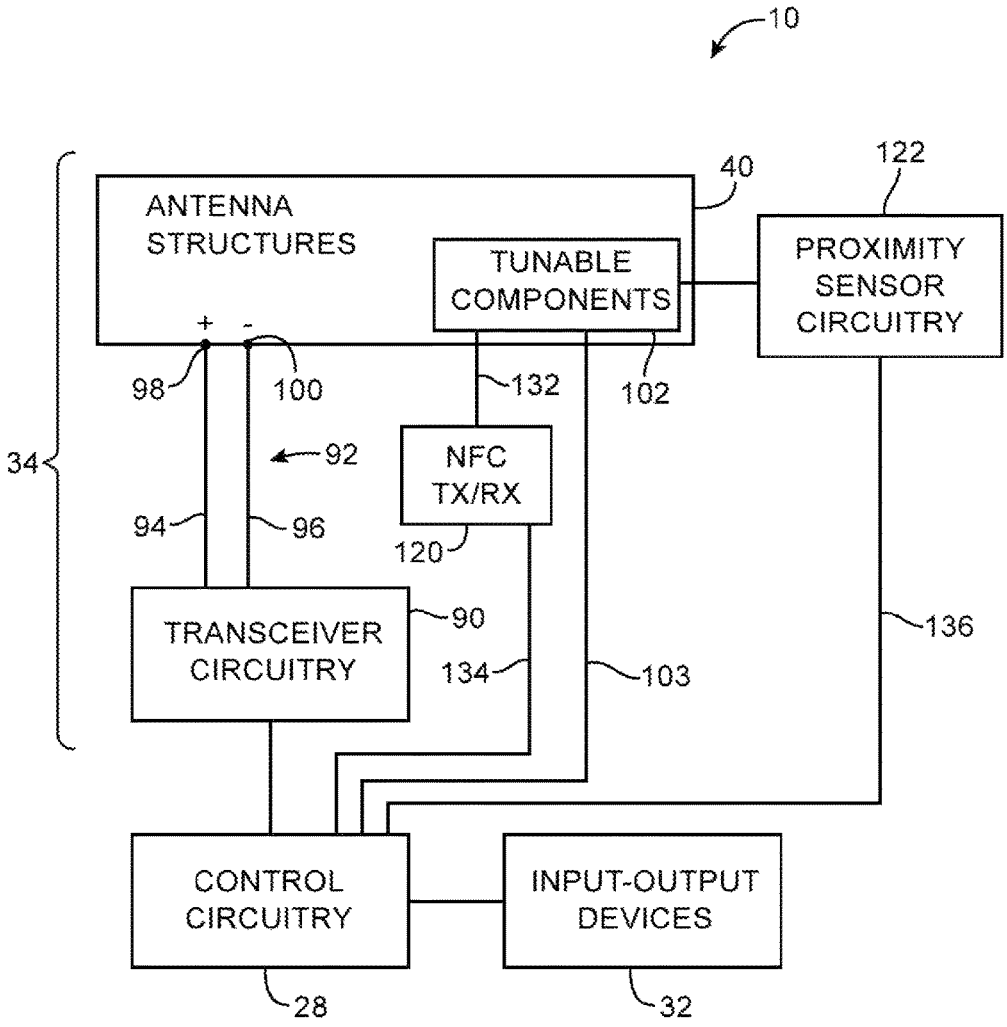
FIG. 6 is a schematic diagram of illustrative wireless circuitry in accordance with an embodiment.

As shown in FIG. 6, non-near-field transceiver circuitry 90 in wireless circuitry 34 may be coupled to antenna structures 40 using paths such as path 92. Near-field communications transceiver circuitry 120 may be coupled to antenna structures 40 using paths such as path 132. Paths such as path 134 may be used to allow control circuitry 28 to transmit near-field communications data and to receive near-field communications data using a near-field communications antenna formed from structures 40. Proximity sensor circuitry 122 may use antenna structures 40 as capacitive proximity sensor electrodes to gather proximity sensor data (i.e., capacitive proximity sensor data indicating whether or not external objects are in the vicinity of device 10). Proximity sensor data may be conveyed from proximity sensor circuitry 122 to control circuitry 28 using paths such as path 136. Proximity sensor data may be used to adjust wireless transmit powers (e.g., to reduce transmit powers for wireless signals being transmitted by transceiver circuitry 90) when external objects are detected in the vicinity of device 10 or to make other wireless circuitry adjustments.

Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with impedance matching circuitry, filters, and other antenna circuitry. This circuitry may include fixed and tunable circuits. Discrete components such as capacitors, inductors, and resistors may be incorporated into the antenna circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. For example, tunable components 102 may include one or more adjustable capacitors (e.g., a programmable capacitor that can produce one of multiple different capacitance values by adjusting switching circuitry), one or more adjustable inductors (e.g., an adjustable inductor circuit having a multiplexer or other adjustable switching circuitry that allows a desired inductor value to be selected from multiple different available inductor values), or other adjustable components.

During operation of device 10, control circuitry 28 may issue control signals on one or more paths such as path 103 that adjust inductance values, capacitance values, or other parameters associated with tunable components 102, thereby tuning antenna structures 40 to cover desired communications bands. Active and/or passive components may also be used to allow antenna structures 40 to be shared between non-near-field-communications transceiver circuitry 90, near-field communications transceiver circuitry 120, and proximity sensor circuitry 122.

Path 92 may include one or more transmission lines. As an example, signal path 92 of FIG. 6 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry and other antenna circuitry in antenna structures 40.

Transmission line 92 may be directly coupled to an antenna resonating element and ground for antenna 40 or may be coupled to indirect-feed antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. As another example, antenna structures 40 may include an antenna resonating element such as a slot antenna resonating element or other element that is indirectly fed. In a indirect feeding arrangements, transmission line 92 is coupled to an antenna feed structure that is used to indirectly feed antenna structures such as an antenna slot or other element through electromagnetic near-field coupling.

Antennas 40 may include slot antenna structures, inverted-F antenna structures (e.g., planar and non-planar inverted-F antenna structures), loop antenna structures, or other antenna structures.

Figure 7:
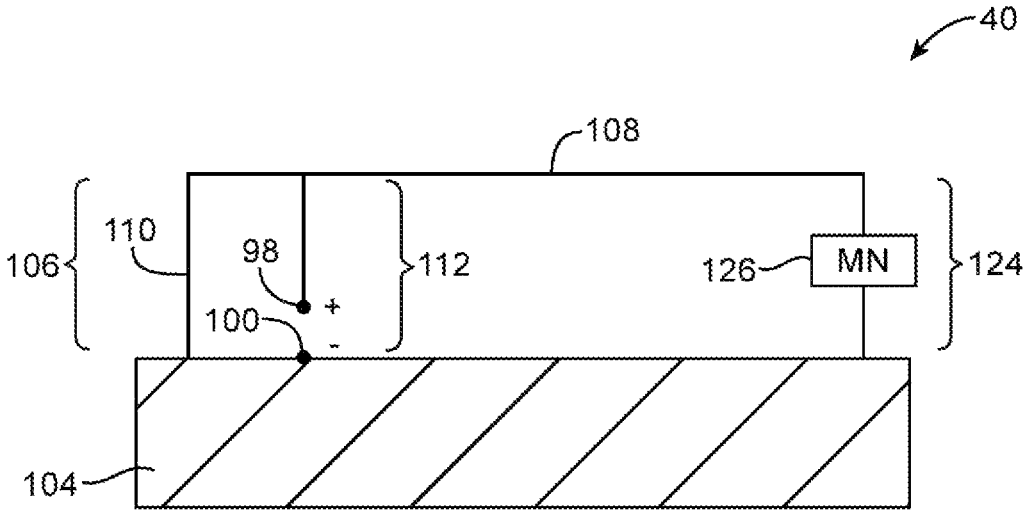
FIG. 7 is a diagram of an illustrative inverted-F antenna structure in accordance with an embodiment.

An illustrative inverted-F antenna structure is shown in FIG. 7. Inverted-F antenna structure 140 of FIG. 7 has antenna resonating element 106 and antenna ground (ground plane) 104. Antenna resonating element 106 may have a main resonating element arm such as arm 108. The length of arm 108 may be selected so that antenna structure 140 resonates at desired operating frequencies. For example, the length of arm 108 may be a quarter of a wavelength at a desired operating frequency for antenna 40. Antenna structure 140 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antenna structures such as illustrative antenna structure 140 of FIG. 7 may have more than one resonating arm branch (e.g., to create multiple frequency resonances to support operations in multiple communications bands) or may have other antenna structures (e.g., parasitic antenna resonating elements, tunable components to support antenna tuning, etc.). A planar inverted-F antenna (PIFA) may be formed by implementing arm 108 using planar structures (e.g., a planar metal structure such as a metal patch or strip of metal that extends into the page of FIG. 7). Antennas such as inverted-F antenna 40 of FIG. 7 may have adjustable circuits such as circuit 126 (sometimes referred to as matching circuits). Circuit 126 may be coupled in path 124 between resonating element arm 108 and ground 104. Adjustments to circuit 126 may be used to adjust the performance of antenna 40 (e.g., the frequency response of antenna 40). Antenna circuitry such as illustrative circuit 126 of FIG. 7 may include tunable components such as components 102 of FIG. 6.

Figure 8:
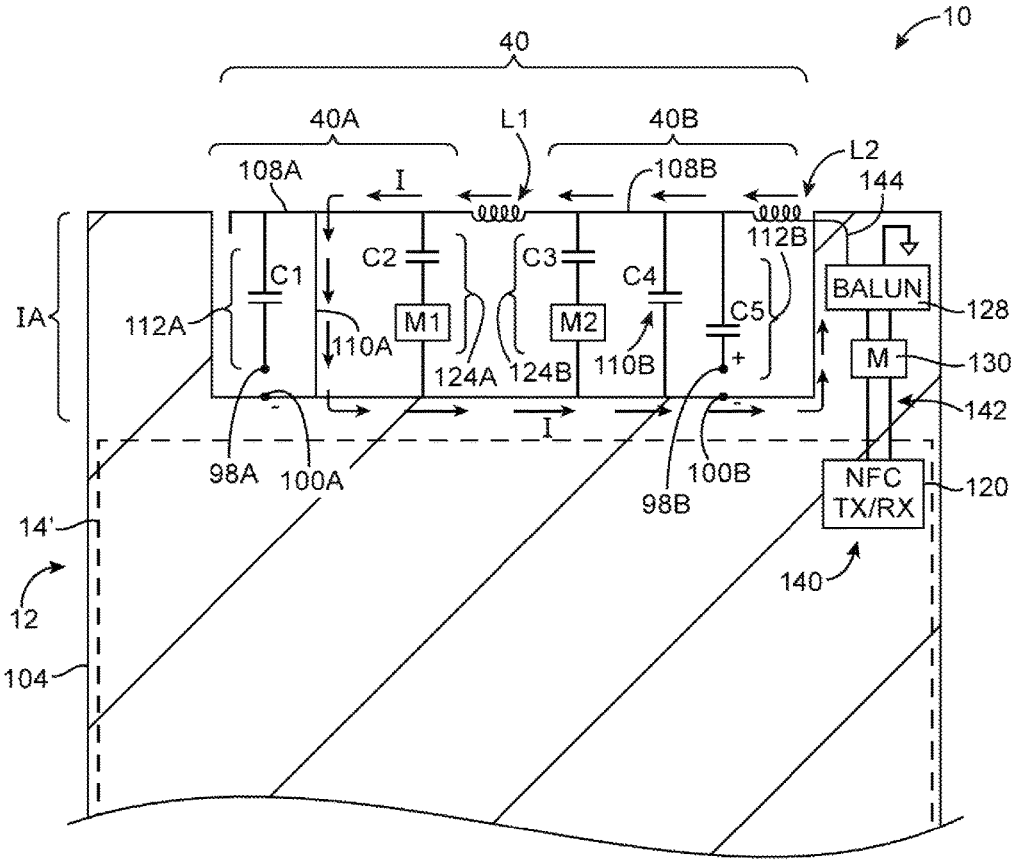
FIG. 8 is a top view of illustrative antenna structures in accordance with an embodiment.

Device 10 may include one or more antennas. A top view of an illustrative portion of device 10 that contains two antennas is shown in FIG. 8. Antennas 40A and 40B may be located in an inactive portion of the display in device 10 such as inactive area IA. A display module or other active display portion for the display may be located in region 14'. Ground plane 104 may be formed from peripheral conductive structures on housing 12, housing walls, a midplate internal housing member, and/or other conductive structures in device 10. Ground plane 104 may serve as an antenna ground for multiple antennas such as antennas 40A and 40B.

Antenna 40A has feed 112A with positive feed terminal 98A and ground feed terminal 100A, resonating element arm 108A, return path 110A, and matching circuit path 124A coupled between arm 108A and ground 104. Capacitor C1 may be interposed in path 112A. Capacitor C2 and matching circuit M1 or other antenna circuitry may be interposed in path 124A. Circuit M1 may be adjustable (e.g., circuit M1 may include tunable components 102 of FIG. 6).

A filter circuit such as a circuit based on inductor L1 (e.g., an inductor having a value of about 80 nH to 200 nH) or other suitable circuit may couple arm 108A of antenna 40A and arm 108B of antenna 40B. This circuit may serve as a low-pass circuit. If desired, other types of filter circuitry may be incorporated into the antenna structures in the position occupied by inductor L1.

Antenna 40B may include antenna feed path 112B with positive feed terminal 98B and ground feed terminal 100B, return path 110B, and matching circuit path 124B. Capacitor C5 may be interposed in path 112B. Capacitor C4 may be interposed in path 110B. Matching circuit M2 or other antenna circuitry and capacitor C3 may be interposed in path 124B. Circuit M2 may include tunable circuitry such as components 102 of FIG. 6. A filter such as a frequency-dependent circuit based on inductor L2 (e.g., an inductor having a value of 80 nH to 200 nH) or other suitable frequency-dependent circuit may couple arm 108B of antenna 40B to near-field communications circuitry 140.

Near-field communications circuitry 140 may include near-field communications transceiver 120, a matching circuit such as matching circuit 130, and a balun such as balun 128. Balun 128 may be used to convert differential near-field communications signals on path 142 to single-ended near-field communications signals on path 144. Other types of near-field communications circuits may be used in handling near-field communications signals for device 10 if desired.

Antennas 40A and 40B are inverted-F antennas. Radio-frequency transceiver circuitry 90 is coupled to antennas 40A and 40B at feeds 112A and 112B (e.g., using respective transmission lines). During operation of circuitry 90, antennas 40A and 40B may serve as a primary and secondary antenna in a two-antenna system. Switching circuitry in device 10 can switch between antennas 40A and 40B to switch an optimum antenna into use in real time (e.g., based on receive signal strength information, based on proximity sensor data, etc.). The frequencies of the signals associated with transceiver circuitry 90 are typically 700 MHz or greater. At these frequencies, inductor L1 forms an open circuit that electrically isolates arm 108A from arm 108B and inductor L2 forms an open circuit to isolate antenna 40B from near-field communications circuitry 140. Capacitors C1, C2, C3, C4, and C5 (e.g., capacitors with values of about 20-30 pF) form short circuits at these frequencies, so that antennas 40A and 40B serve as inverted-F antennas for transceiver circuitry 90. Near-field communications circuitry 140 may operate at lower frequencies (e.g., at 13.56 MHz). At near-field communications frequencies, capacitors C1, C2, C3, C4, and C5 form open circuits, isolating the paths containing these capacitors from near-field communications signal currents. Inductors L1 and L2 form short circuits at near-field communications frequencies, so near-field communications signal currents such as illustrative near-field communications current I can flow through a loop antenna formed from portions of antennas 40A and 40B. Current I may, for example, flow in a loop through arm 108B of antenna 40B, arm 108A of antenna 40A, return path 110A of antenna 40A, and ground 104.

As this example demonstrates, antenna structures 40 of FIG. 8 can serve both as a non-near-field communications antenna structures (i.e., inverted-F antenna 40A and inverted-F antenna 40B) and as near-field communications antenna structures (i.e., a loop antenna formed from portions of antennas 40A and 40B). The ability to share antenna structures 40 between both near-field and non-near-field functions allows the size of antenna structures 40 to be minimized and avoids duplication of antenna parts.

Figure 9:
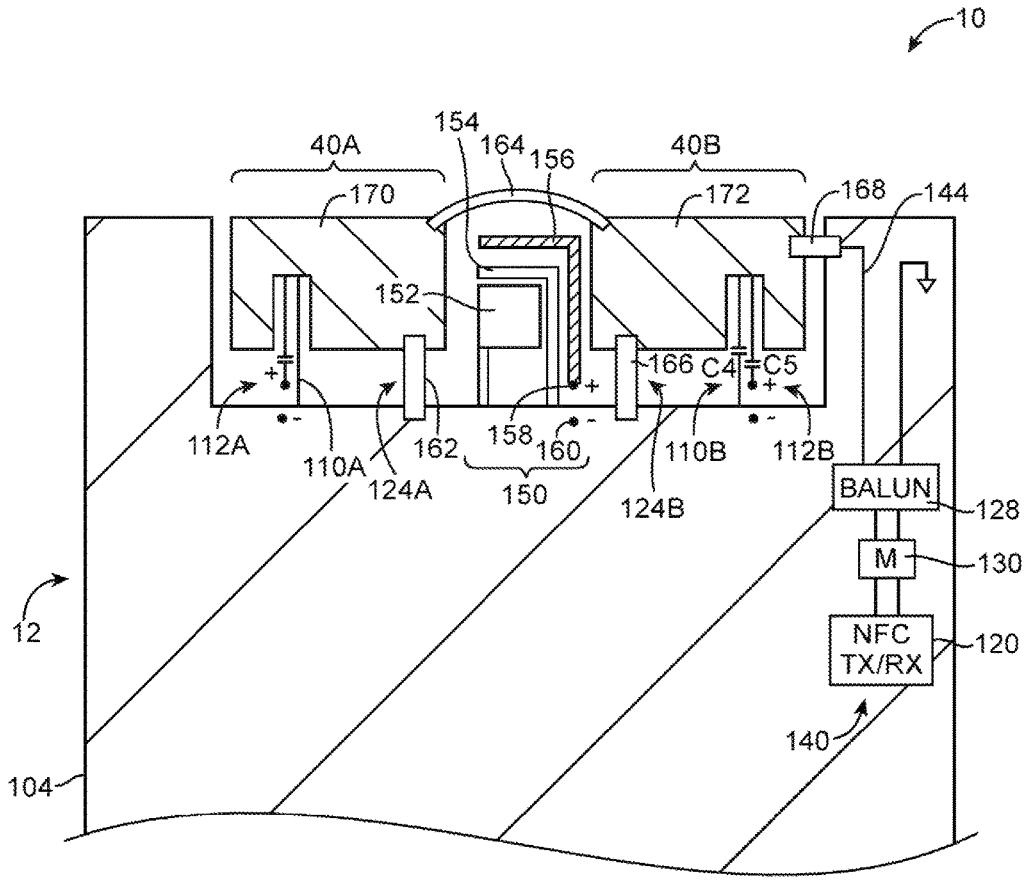
FIG. 9 is a top view of substrates and other structures that may be used in forming the illustrative antenna structures of FIG. 8 in accordance with an embodiment.

FIG. 9 is a top view of a portion of device 10 showing illustrative components that may be used in implementing antenna structures such as antenna structures 40 of FIG. 8. As shown in the example of FIG. 9, device 10 may have a first antenna substrate such as substrate 170 for forming portions of antenna 40A (e.g., resonating element arm 108A, etc.) and may have a second antenna substrate such as substrate 172 for forming portions of antenna 40B (e.g., resonating element arm 108B). Substrates 170 and 172 may be printed circuits, plastic carriers, or other antenna support structures carrying patterned metal traces or other conductive antenna structures. Components such as components 162 and 166 (e.g., strips of flexible printed circuit material populated with electrical devices such as capacitor C2, matching circuit M1, capacitor C3, and matching circuit M2) may be used to couple traces on substrates 170 and 172 (e.g., arms 108A and 108B) to ground 104. Substrate 164 may carry an inductor such as inductor L1 or other filter circuit and may be used to couple substrate 170 to substrate 172. Component 168 may be an inductor other filter circuit that couples substrate 172 to path 144. If desired, fewer substrates or more substrates may be used in implementing antennas 40A and 40B. For example, a single substrate may carry metal traces and components for both antennas 40A and 40B, one or more additional substrates may be used in forming antenna structures 40, etc. The example of FIG. 9 is merely illustrative.

Antennas 40A and 40B may be separated by region 150. Components may be formed in region 150 such as component 152 (e.g., a camera on a flexible printed circuit), component 154 (e.g., a microphone on a flexible printed circuit), and component 156 (e.g., a monopole satellite navigation system antenna that is fed using antenna feed terminals 158 and 160). Flexible printed circuits can be coupled using hot-barred solder connections or other suitable conductive attachment mechanisms. If desired, the portions of device 10 above and below antenna structures 40 may be dielectric structures so that antenna structures 40 can be used for near-field communications (and non-near-field communications) through both the front and rear of device 10 (as an example).

Figure 10:
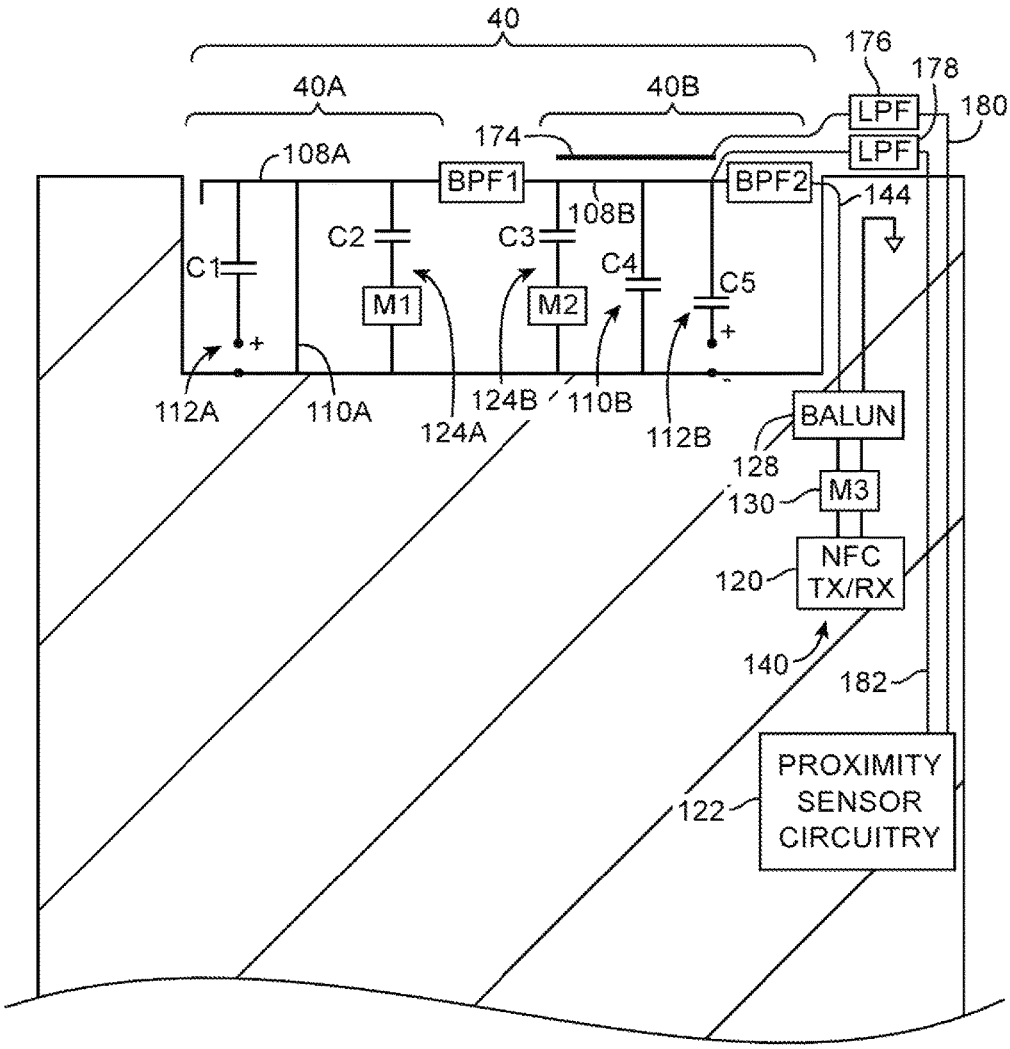
FIG. 10 is a top view of illustrative antenna structures that may be used to gather proximity sensor data in accordance with an embodiment.

The diagram of FIG. 10 shows how proximity sensor circuitry may be incorporated into antenna structures 40. As shown in FIG. 10, a proximity sensor for device 10 may be formed from a structure such as proximity sensor flex 174 and metal arm 108B in antenna 40B. Proximity sensor flex 174 may be a flexible printed circuit or other printed circuit that contains metal traces for forming proximity sensor electrode structures. Arm 108B may serve as a portion of antenna 40B and may also form a proximity sensor structure (e.g., a capacitive proximity sensor electrode, a shield layer, etc.). Proximity sensor structure 174 may be coupled to proximity sensor circuitry 122 by low-pass filter 176 and path 180. The proximity sensor structure formed from antenna resonating element arm 108B of antenna 40B may be coupled to proximity sensor circuitry 122 by low pass filter 178 and path 182. Proximity sensor circuitry 122 may operate at a proximity sensor frequency below that used for near-field communications circuitry 140. As an example, proximity sensor circuitry 122 may operate at a frequency of about 200 kHz.

Antenna resonating element arm 108A of antenna 40A may be coupled to an end of antenna resonating element arm 108B of antenna 40B by band pass filter BPF1. Band pass filter BPF2 may be used to couple an opposing end of antenna resonating element arm 108B to near-field communications signal path 144. Band pass filters BPF1 and BPF2 may each have a pass band that is centered on near-field communications frequencies (e.g., these filters may be short circuits at 13.56 MHz) and may be configured to form open circuits and thereby block signals below or above this frequency range. This allows band pass filters BPF1 and BPF2 to form closed circuits for forming an NFC antenna at NFC frequencies, while forming open circuits at proximity sensor frequencies associated with proximity sensor circuitry 122 and at non-near-field communications frequencies associated with transceiver circuitry 90.

Non-near-field communications circuitry 90 may have a first transmission line coupled to feed 112A and a second transmission line coupled to feed 112B. When operating at non-near-field communications frequencies (i.e., frequencies above 700 MHz), band pass filter BPF2 will be an open circuit and will isolate arm 108B from path 144. Band pass filter BPF1 will be an open circuit and will isolate arm 108A from arm 108B, thereby isolating antennas 40A and 40B from each other. Capacitors C1, C2, C3, C4, and C5 form short circuits that configure antenna structures 40 into inverted-F antenna 40A and inverted-F antenna 40B. Low pass filters 176 and 178 are open circuits at frequencies above 700 MHz, so proximity sensor circuitry 122 is isolated from antennas 40A and 40B. The use of filters BPF1, BPF2, LPF 176, and LPF 178, and the filter circuitry formed from capacitors C1, C2, C3, C4, and C5 therefore allows antennas 40A and 40B to be used to handle cellular telephone communications, wireless local area network communications, optional satellite navigation system communications, etc.

At low frequencies associated with proximity sensor circuitry 122 (e.g., at 200 kHz or other frequency below the near-field communications frequency of 13.56 MHz), low pass filters 176 and 178 form short circuits. This electrically couples proximity sensor circuitry 122 to capacitive proximity sensor electrodes 174 and 108B. Band pass filters BPF1 and BPF2 and capacitors C1, C2, C3, C4, and C5 are open circuits at proximity sensor signal frequencies, so when proximity sensor circuitry 122 is being used to gather capacitive proximity sensor signals, only structures 174 and 108B are being used by proximity sensor circuitry 122. The other portions of antenna structures 40 are electrically isolated from structures 174 and 108B. Structures 174 and 108B may be located near the periphery of device 10 and are preferably configured to serve as proximity sensor electrodes when electrically disconnected from near-field communications circuitry 140 and the portions of antenna structures 40 other than structure 108B.

At near-field communications frequencies, low pass filters 176 and 178 are open circuits, which isolates proximity sensor circuitry 122 from antenna structures 40. Capacitors C1, C2, C3, C4, and C5 are open circuits and band pass filters BPF1 and BPF2 are short circuits. This configures antenna structures 40 to serve as a near-field communications loop antenna. As described in connection with FIG. 8, near-field communications antenna loop currents flow from near-field communications path 144 through band-pass filter BPF2, through antenna resonating element arm 108B, through band pass filter BPF1, through arm 108A, through return path 110A, and through ground 104. At near-field communications frequencies, structures 40 therefore serve as a near-field communications loop antenna for handling signals transmitted and received by near-field communications transceiver 120, rather than serving as inverted-F antennas 40A and 40B for handling non-near-field communications signals.

The example of FIG. 10 shows how antenna structures 40 can form proximity sensor electrodes at low frequencies, a near-field communications antenna at medium frequencies, and non-near-field communications antenna(s) at high frequencies. Other types of shared antenna structures and associated filter circuits may be used in supporting proximity sensing, NFC communications, and non-NFC communications if desired. The example of FIG. 10 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

antenna structures that comprise filtering circuitry;

non-near-field communications circuitry coupled to the antenna structures;

near-field communications circuitry coupled to the antenna structures; and proximity sensor circuitry coupled to the antenna structures, wherein the filtering circuitry configures the antenna structures to form a first antenna having a first resonating element arm configured to operate at frequencies associated with the non-near-field communications circuitry and a second antenna having a second resonating element arm that is configured to operate at the frequencies associated with the non-near-field communications circuitry and that is separate from the first resonating element arm when the antenna structures are operated at the frequencies associated with the non-near-field communications circuitry.

2. The electronic device defined in claim 1 further comprising a low-pass filter that couples the proximity sensor circuitry to the second resonating element arm.

3. The electronic device defined in claim 2 further comprising a band pass filter that couples the near-field communications circuitry to the second resonating element arm.

4. The electronic device defined in claim 3, wherein the first antenna, the second antenna, and the filtering circuitry form a loop antenna for the near-field communications circuitry at near-field communications frequencies associated with use of the near-field communications circuitry.

5. The electronic device defined in claim 4 wherein the filtering circuitry comprises capacitors coupled between the first resonating element arm and an antenna ground.

6. The electronic device defined in claim 5 wherein the filtering circuitry comprises a band pass filter.

7. The electronic device defined in claim 6 wherein the band pass filter is connected to an end of the first antenna resonating element arm.

8. The electronic device defined in claim 1 wherein the first antenna comprises a first inverted-F antenna and the second antenna comprises a second inverted-F antenna, and the first and second inverted-F antennas are shorted together when operating at frequencies associated with the near-field communications circuitry.

9. The electronic device defined in claim 8 wherein the first inverted-F antenna comprises the first resonating element arm, a first feed, and a first return path, the second inverted-F antenna comprises the second resonating element arm, a second feed, and a second return path, the antenna structures include an antenna ground, the first return path is coupled between the first resonating element arm and the antenna ground, and antenna currents associated with near-field communications signals flow through the second resonating element arm, the first resonating element arm, the first return path, and the antenna ground when the antenna structures are operated at frequencies associated with the near-field communications circuitry.

10. An electronic device, comprising:

a first inverted-F antenna having a first antenna resonating element that includes a first antenna resonating element arm and a first return path coupling the first antenna resonating element arm to an antenna ground;

a second inverted-F antenna having a second antenna resonating element that includes a second antenna resonating element arm and a return path coupling the second antenna resonating element arm to the antenna ground; and a band pass filter galvanically connected between the first antenna resonating element arm and the second antenna resonating element arm, wherein a portion of the first antenna resonating element, a portion of the second antenna resonating element, and the band pass filter form a conductive path associated with a third antenna resonating element for a third antenna.

11. The electronic device defined in claim 10 wherein the second antenna resonating element arm has opposing first and second ends and wherein the band pass filter is coupled between the first end of the second antenna resonating element arm and the first antenna resonating element arm.

12. The electronic device defined in claim 11 further comprising a capacitor interposed in the return path of the second inverted-F antenna.

13. The electronic device defined in claim 12 further comprising an additional band pass filter coupled to the second end of the second antenna resonating element arm.

14. The electronic device defined in claim 13 further comprising near-field communications circuitry coupled to the additional band pass filter.

15. The electronic device defined in claim 14 further comprising proximity sensor circuitry coupled to the second inverted-F antenna.

16. The electronic device defined in claim 15 further comprising a low pass filter in a path coupling the proximity sensor circuitry to the second antenna resonating element arm.

17. The electronic device defined in claim 10, wherein the second antenna resonating element arm has first and second opposing ends, the band pass filter is coupled to the first end of the second antenna resonating element arm, and communications circuitry for the third antenna is coupled to the second end of the second antenna resonating element arm.

18. An electronic device, comprising:

non-near-field communications circuitry that operates at a non-near-field communications frequency;

a first antenna having a first feed that is coupled to the non-near-field communications circuitry to handle non-near-field communications;

a second antenna having a second feed that is coupled to the non-near-field communications circuitry to handle non-near-field communications;

a band pass filter coupled between the first antenna and the second antenna; and near-field communications circuitry that operates at a near-field communications frequency, wherein the band pass filter forms a portion of a third antenna that is coupled to the near-field communications circuitry and configured to handle near-field communications.

19. The electronic device defined in claim 18 wherein the non-near-field communications circuitry includes transceiver circuitry operating at a non-near-field communications frequency of at least 700 MHz and wherein the band pass filter is an open circuit at the non-near-field communications frequency.

20. The electronic device defined in claim 19 further comprising proximity sensor circuitry coupled to the second antenna that operates at a proximity sensor frequency, wherein the band pass filter is an open circuit at the proximity sensor frequency.

* * * * *